United States Patent [19]

Dennis et al.

[11] Patent Number: 4,979,559

[45] Date of Patent: Dec. 25, 1990

[54] STACKING SUPPORT BRACKETS

[75] Inventors: Richard D. Dennis, Bridgeport; Frederick L. Miller, Jr., Syracuse, both of N.Y.

[73] Assignee: Carrier Corporation, Syracuse, N.Y.

[21] Appl. No.: 479,895

[22] Filed: Feb. 14, 1990

[51] Int. Cl.[5] ..... F28F 9/00

[52] U.S. Cl. ..... 165/67; 62/259.1

[58] Field of Search ..... 165/67, 68, 143, 144; 62/259.1, 263; 248/674, 675; 211/194

[56] References Cited

U.S. PATENT DOCUMENTS

| | | | |
|---|---|---|---|
| 2,120,797 | 6/1938 | Cornell, Jr. | 165/67 |
| 2,400,224 | 5/1946 | Christensen | 165/67 |
| 3,220,711 | 11/1965 | Leppard et al. | 62/263 |
| 4,097,012 | 6/1978 | McIntyre | 248/674 |
| 4,118,083 | 10/1978 | Lackey et al. | 165/67 |
| 4,531,574 | 7/1985 | Hoch | 165/67 |
| 4,796,763 | 1/1989 | Franklin et al. | 211/194 |

FOREIGN PATENT DOCUMENTS

| | | | |
|---|---|---|---|
| 2446450 | 4/1976 | Fed. Rep. of Germany | 165/67 |
| 645283 | 10/1928 | France | 165/67 |

*Primary Examiner*—John Rivell
*Assistant Examiner*—L. R. Leo
*Attorney, Agent, or Firm*—Dana F. Bigelow

[57] ABSTRACT

Provision is made for stacking one condenser on another by mounting apparatus which includes a channel for receiving and supporting the existing feet at the base of the upper unit, and a clip member for securing the combination to the lower edge of the lower unit cover. Where the upper and lower units are the same size, a single fastener attaches both the feet and the clip to the channel. Where the upper unit is smaller than the lower unit, separate fasteners are applied to secure the feet to the channel and to secure the channel to the clip.

16 Claims, 3 Drawing Sheets

STACKING SUPPORT BRACKETS

BACKGROUND OF THE INVENTION

This invention relates generally to condenser coil units and, more specifically, to method and apparatus for the vertical stacking of one on another A so called "split system" in air conditioning parlance includes an outdoor, or condenser coil and an indoor or evaporator coil, with the two being interconnected by way of refrigerant lines. The system is normally designed such that the size and capacity of the outdoor coil is matched with that of the indoor coil to thereby obtain high efficiency performance.

There are occasions when multiple outdoor and/or indoor coils are used in the system. For example, in a so called "multiplex" system, a single outdoor coil may serve to operate with multiple indoor coils which are dispersed in various locations within the building. Or there may, for example, be two outdoor coils that serve three or more indoor coils in the same manner.

Another multiple coil arrangement may involve the use of a plurality of relatively low capacity outdoor coils connected in cascade fashion to serve a single or plural indoor coils. One advantage to such an arrangement is that a plurality of smaller units are easier to handle than a single large unit, in terms of storage, shipping, repair and replacement. With a multiple outdoor coil arrangement, it is preferred to have the coils in close proximity to each other, and a stacking arrangement is generally preferred over a side by side arrangement. With such a stacking arrangement, it is recognized that an unstable condition may exist, especially where the height of the units are greater than the width or thickness thereof. Provision must therefore be made to prevent the upper unit from sliding off, or tipping over, from the lower unit. In this regard, it is further recognized that such outdoor units may be exposed to rain, ice, and high wind conditions.

A possible approach is to provide an external frame structure around the two coils. However, such an arrangement is relatively expensive, complicated, and tends to limit access to the units for service. Another possibility is that of supporting the upper coil from an adjacent structure such as the side wall of the building. This again, limits access to the upper unit and tends to detract from the appearance of the system.

To further complicate the requirements for such a stacked system, it is recognized that the upper unit may have bolt heads and other such structure extending from its lower surface to prevent it from being placed directly on the upper surface of the lower unit. Further, the lower of the stacked units may be mounted on a base sitting on the ground or it may be mounted to a wall. Also, the upper unit may be either the same size or smaller than the lower unit.

It is therefore an object of the present invention to provide a practical means of stacking one condenser unit on another.

Another object of the present invention is the provision in a stacked coil arrangement for preventing the upper unit from sliding off or tipping over.

Yet another object of the present invention is the provision for simply and economically securing one unit over another without limiting access thereto. These objects and other features and advantages become more readily apparent upon reference to the following description when taken in conjunction with the appended drawings.

SUMMARY OF THE INVENTION

Briefly, in accordance with one aspect of the invention, a pair of spaced channels are secured to the upper surface of the lower coil in such positions as to correspond to and register with the existing mounting brackets on the lower surface of the upper unit. The mounting brackets of the upper units are also secured to the channels of the lower units.

By another aspect of the invention, the channels are secured to the lower unit by way of L-shaped clips which hook under downwardly extending portions of the lower unit top cover, and then extend upwardly to substantially the same level as the top cover and then project normally outwardly to meet with the outwardly extending foot of the mounting bracket. With an upper and lower unit of the same size, a single fastener can then be applied to interconnect the mounting feet, the channel and the clip projection.

By yet another aspect of the invention, provision is made to stack a smaller unit on a larger unit by separate fasteners at each mounting location, with one being used to attach the channel to the mounting clip and another being used to attach the mounting bracket foot to the channel.

In the drawings as hereinafter described, a preferred and modified embodiments are depicted; however, various other modifications and alternate constructions can be made thereto without departing from the true spirit and scope of the invention.

DESCRIPTION OF THE PREFERRED EMBODIMENT

Figure 1:
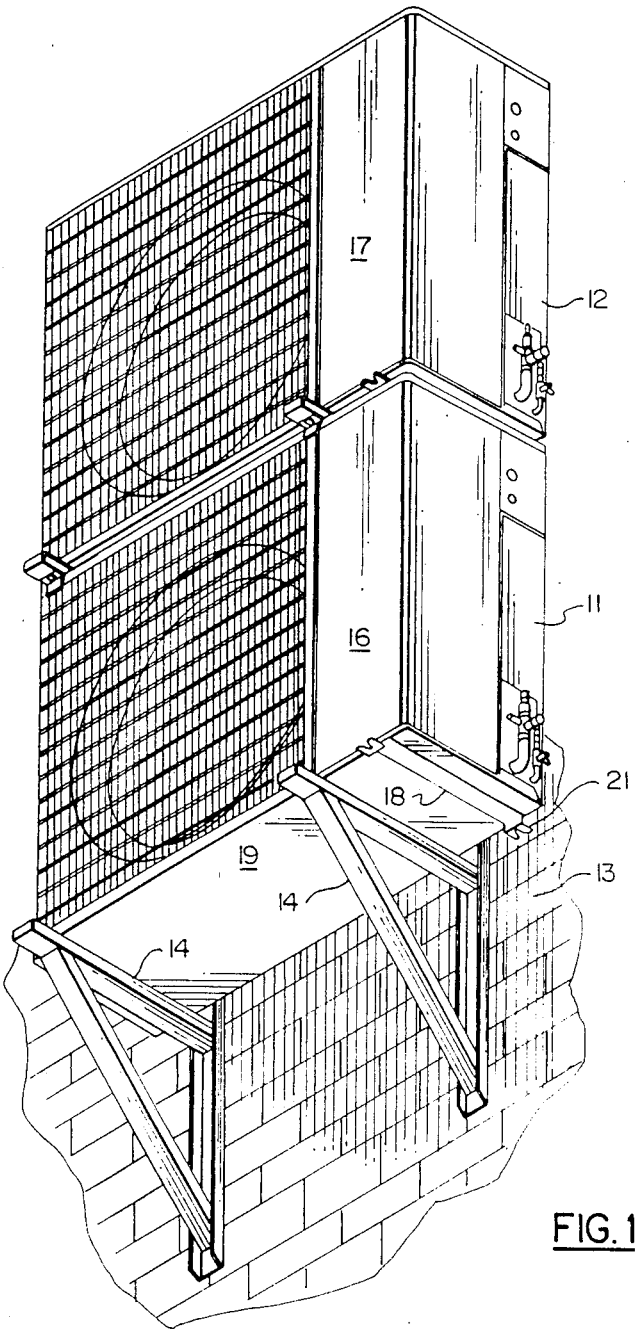
FIG. 1 is a perspective view of a pair of stacked condenser units with the present invention incorporated therein.

Referring now to FIG. 1, the invention is shown generally at 10 as incorporated into a stacked combination of lower 11 and upper 12 condenser units which are mounted near a wall 13 by a pair of supports 14. The condenser units 11 and 12 are fluidly connected by refrigerant lines to one or more evaporator coils in a conventional manner and operate to condense the refrigerant in the circuit by way of the air which flows in the front sides 16 and 17 and out their respective backsides which are appropriately spaced from the wall 13 for that purpose. Rather than being wall mounted, the condenser units may be mounted on a base which is placed on the ground near the building.

Figure 2:
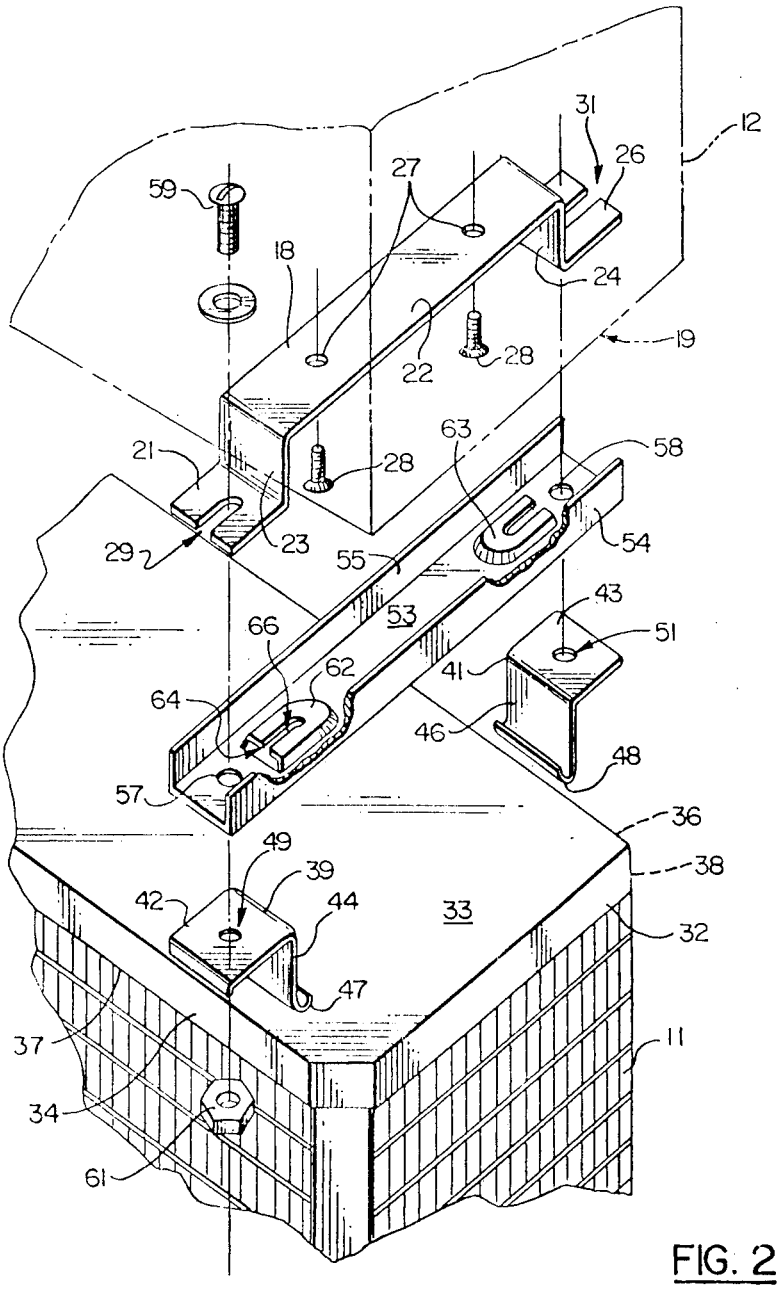
FIG. 2 is an exploded view of the mounting apparatus portion thereof.

A plurality of longitudinally spaced mounting brackets 18 are secured to a bottom member 19 of each of the units by way of welding or the like. The brackets 18 have feet 21 on either end thereof which rest on, and are secured to, the supporting surface. These brackets and their supporting feet are used, along with the adaptive structure of the present invention, in mounting the upper unit 12 on the lower unit 11 in a stacked manner. Referring now to FIG. 2, the mounting bracket 18 is shown to include a flat plate upper portion 22, downwardly depending end sections 23 and 24 and outwardly extending feet 21 and 26. The upper portion 22 has holes 27 formed therein for the insertion of fasteners 28. Alternatively, ; the upper portion 22 may be welded to the bottom member 19 as mentioned hereinabove. At the ends of the feet 21 and 26 are respective slots 29 and 31 for insertion of a fastener in a manner to be described hereinbelow.

Turning now to the adaptive structure of the present invention, the lower unit 11 is recognized as having an installed cover 32 with a top surface 33 and depending sides 34 and 36. The depending sides 34 and 36 have respective exposed lower edges 37 and 38 which are used to secure the brackets in accordance with the present invention.

A pair of L-shaped hook members 39 and 41 are provided with respective upper elements 42 and 43, downwardly extending elements 44 and 46, and hook portions 47 and 48. The hook portions 47 and 48 engage the respective lower edges 37 and 38, and the downwardly extending elements 44 and 46 engage the respective depending sides 34 and 36. The outwardly projecting upper elements 42 and 43, with their included holes 49 and 51, respectively, are available for attachment to structure thereabove.

As previously mentioned, the bottom member 19 of a condenser unit normally has various fastening devices extending downwardly below its surface such that the upper unit 12 can not be made to rest directly on the top surface 33 of the lower unit 11. An elongate channel member 52 is therefore provided under each of the mounting brackets 18, so as to support them in an elevated position.

The channel element 52 has a base 53 and upstanding sidewalls 54 and 55. Formed in the base member 53 are holes 57 and 58 for receiving a fastener 59 therein. The channel member 52 rests on the upper surface 33 of the lower unit 11, with its ends above the hook member upper elements 42 and 43. The upper unit 12 is then placed above the lower unit 11 so that the mounting feet 21 and 26 rest on the channel base 53 such that the slots 29 and 31 register with the holes 57 and 58. The fastener 59 is then inserted through the slot 29, the hole 57 and the hole 49, and a nut 61 is fastened thereto to secure the combination in place. Fasteners are applied to the other end of the mounting bracket 18 and to the other mounting brackets (not shown) in the same way. In this way, the upper unit 12 is securely fastened to the lower unit 11 in a manner which prevents tipping or sliding of the upper unit 12.

As an alternative, the bolt 59 may be an I-bolt to which a guy wire may be attached for further stabilizing the assembly in the event of extremely high winds.

Figure 3:
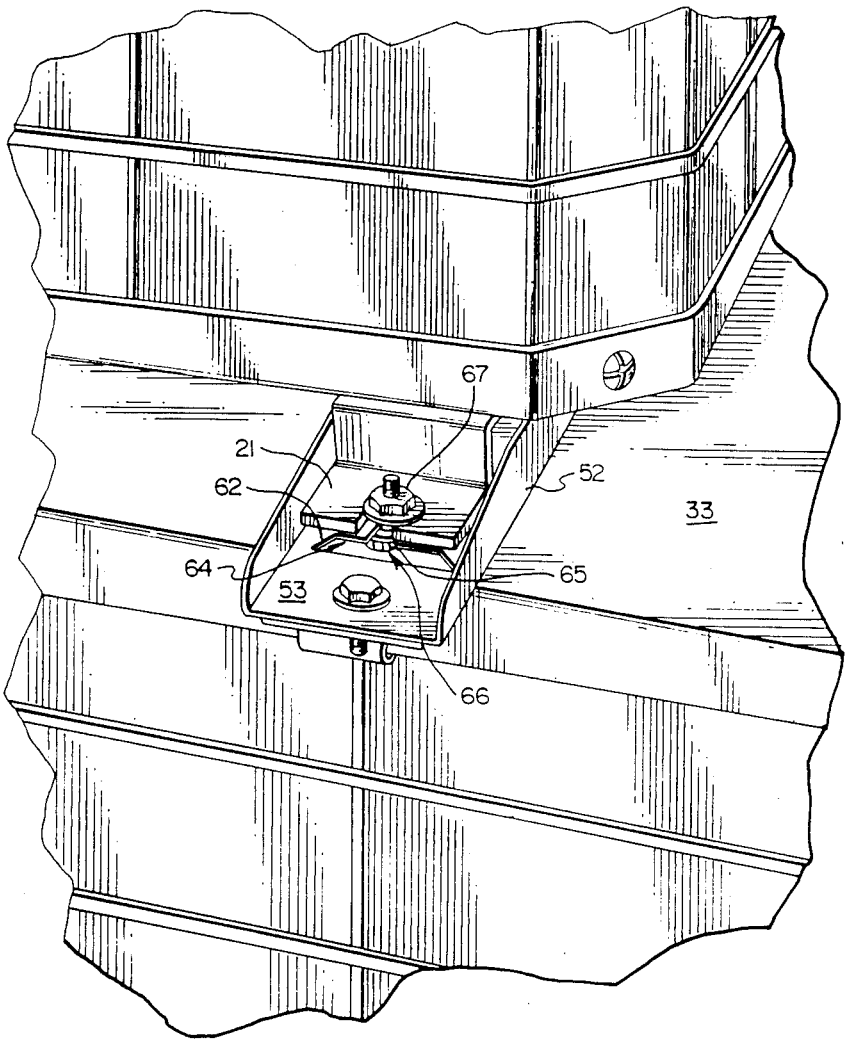
FIG. 3 is a modified embodiment thereof with the mounting apparatus accommodating different sized units.

In order to allow for the installation of a upper unit 12 which is smaller in size than the lower unit 11, the channel base 53 has a pair of risers 62 and 63 formed therein, as shown in FIG. 2. The risers are formed by deforming a portion of the base element 53 in a process such as by stamping or the like. A cavity 64 is thus formed for receiving the head 65 of a bolt which then extends upwardly through a slot 66, and then through the slot 29 of the foot 21 to receive a nut 67 for securing the combination in place as shown in FIG. 3.

While the present invention has been disclosed with particular reference to preferred and modified embodiments, the concepts of this invention are readily adaptable to other methods and embodiments, and those skilled in the art may vary the structure thereof without departing from the essential spirit of the invention.

What is claimed is:

1. An improved arrangement for multiple condenser units of an air conditioning system comprising:

a first condenser unit having top and bottom members, said bottom member being adapted for placement above a support structure and said top member having attached thereto a pair of longitudinally spaced channels extending transversely across said top member;

a second condensing unit having a bottom member for placement above said channels and having attached thereto a pair of longitudinally spaced brackets; and fastener means for interconnecting said brackets to said channels to secure said second condenser unit to said first condenser unit in a supported relationship.

2. An improved arrangement as set forth in claim 1 and including a securing member at each end of each of said channels, said securing member being attachable at its one end to said channel one end and at its other end to said first condenser unit upper surface.

3. An improved arrangement as set forth in claim 2, wherein said securing member is L-shaped in form and has a hook shaped extension at its other end for engaging an edge of said first condenser unit top member.

4. An improved arrangement as set forth in claim 3, wherein said brackets are U-shaped in form and have additional feet members extending substantially normally from the ends of said U-shaped members.

5. An improved arrangement as set forth in claim 2, wherein said securing members are attached to said channel members near the ends of said channel members.

6. An improved arrangement as set forth in claim 5, wherein a common fastener is used to interconnect said brackets to said channels and to connect said securing members to said channels.

7. An improved arrangement as set forth in claim 1, wherein said channel members include riser portions and further wherein said fastener means is attached to interconnect the brackets to said riser portions.

8. A method of mounting a supported condenser unit above a supporting condenser unit comprising the steps of:

securing a plurality of longitudinally and transversely spaced mounting brackets to a bottom member of the supported unit, said mounting brackets each having a foot member with fastener openings formed therein;

providing transversely and longitudinally spaced clip members and securing them to a top member of the supporting unit, said clip members having fastening holes formed therein for registration with said feet openings; and inserting a fastener into each pair of said registered holes to thereby secure the supported unit to the supporting unit.

9. A method as set forth in claim 8, wherein said supported unit has a plurality of members depending from said bottom member thereof and further including the step of providing a spacer member between said mounting bracket and said clip member.

10. A method as set forth in claim 9, wherein said spacer member is U-shaped in cross section.

11. A method as set forth in claim 8, wherein said transversely spaced mounting brackets are secured to said bottom by way of an interconnecting cross piece.

12. A method as set forth in claim 8, wherein said clip members include hooks on one end thereof and said clip members are secured to said top member of said supporting unit by engaging said hooks with an edge of said supporting unit top member.

13. A method as set forth in claim 8, and further including the step of providing an intermediate member between said bracket and said clip member.

14. A method as set forth in claim 13, wherein said bracket, said intermediate member and said clip member are interconnected by a common fastener.

15. A method as set forth in claim 13, wherein said bracket member is connected to said intermediate member by one fastener and said intermediate member is connected to said clip member by another fastener.

16. A method as set forth in claim 13, and including the step of providing a riser member in said intermediate member for interconnection to said bracket member.

* * * * *